US007891580B2

(12) United States Patent
Valpey, III et al.

(10) Patent No.: US 7,891,580 B2
(45) Date of Patent: Feb. 22, 2011

(54) HIGH VOLUME ATOMIZER FOR COMMON CONSUMER SPRAY PRODUCTS

(75) Inventors: Richard S. Valpey, III, Lindenhurst, IL (US); Wenlu Gu, Racine, WI (US); Thomas A. Helf, New Berlin, WI (US); Thomas P. Blandino, Cottage Grove, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 12/112,714

(22) Filed: Apr. 30, 2008

(65) Prior Publication Data

US 2009/0272818 A1 Nov. 5, 2009

(51) Int. Cl.
*B05B 1/08* (2006.01)

(52) U.S. Cl. ..... 239/102.2; 239/69; 239/145; 239/326; 239/552; 239/596; 128/200.16

(58) Field of Classification Search ..... 239/69, 239/102.1, 102.2, 145, 326, 548, 552, 596, 239/601; 128/200.16
See application file for complete search history.

(56) References Cited

U.S. PATENT DOCUMENTS

| | | | | |
|---|---|---|---|---|
| 4,119,096 | A | 10/1978 | Drews | |
| 4,753,579 | A | 6/1988 | Murphy | |
| 4,877,989 | A | 10/1989 | Drews et al. | |
| 5,511,726 | A | 4/1996 | Greenspan et al. | |
| 5,518,179 | A * | 5/1996 | Humberstone et al. | 239/102.2 |
| 5,685,485 | A | 11/1997 | Mock et al. | |
| 5,823,428 | A * | 10/1998 | Humberstone et al. | 239/601 |
| 6,293,474 | B1 | 9/2001 | Helf et al. | |
| 6,296,196 | B1 * | 10/2001 | Denen et al. | 239/102.2 |
| 6,339,897 | B1 | 1/2002 | Hayes et al. | |
| 6,378,780 | B1 | 4/2002 | Martens, III et al. | |
| 6,382,522 | B2 | 5/2002 | Tomkins et al. | |
| 6,439,474 | B2 | 8/2002 | Denen | |
| 6,450,417 | B1 | 9/2002 | Gipson et al. | |
| 6,450,419 | B1 | 9/2002 | Martens, III et al. | |
| 6,540,153 | B1 * | 4/2003 | Ivri | 239/102.2 |
| 6,706,988 | B1 * | 3/2004 | Helf et al. | 200/553 |
| 6,843,430 | B2 | 1/2005 | Boticki et al. | |
| 6,854,662 | B2 * | 2/2005 | Chen | 239/102.2 |
| 6,857,580 | B2 * | 2/2005 | Walter et al. | 239/102.2 |
| 6,921,020 | B2 * | 7/2005 | Ivri | 239/102.2 |
| 6,969,008 | B2 | 11/2005 | Helf et al. | |
| 7,017,829 | B2 | 3/2006 | Martens, III et al. | |
| 7,108,197 | B2 * | 9/2006 | Ivri | 239/102.2 |
| 7,281,811 | B2 | 10/2007 | Thuot Rann et al. | |
| 2005/0023368 | A1 | 2/2005 | Valpey, III et al. | |
| 2005/0271371 | A1 | 12/2005 | Wefler | |
| 2006/0011737 | A1 * | 1/2006 | Amenos et al. | 239/102.1 |
| 2006/0026817 | A1 | 2/2006 | Valpey, III et al. | |

* cited by examiner

*Primary Examiner*—Steven J Ganey

(57) ABSTRACT

A high volume piezoelectric atomizer for use with common consumer spray products is disclosed. The piezoelectric atomizer may include an actuator, a substrate and a supply of a liquid product to be dispensed. The substrate may include a plurality of tapered perforations in direct contact with the supply of a liquid product. A control circuit vibrates the actuator, substrate and its tapered perforations against the supply at velocities of at least 500 mm/s. Droplets are dispensed at a delivery rate of approximately 0.2 g/s resulting in plumes of at least 2 feet in length resulting in a Valpey factor of at least 51.0.

27 Claims, 9 Drawing Sheets

FIG. 6A

| | A | B |
|---|---|---|
| Plate dimensions | 15mm x 15mm x 0.08mm | 17.7mm x 17.7mm x 0.08 mm |
| Dimensions of perforated area | 12mm x 12mm | 17.7mm x 7.7mm |
| Average perforation area | 530 mm2 | 1960 mm2 |
| Number of perforations | 10,800 | 17,324 |

FIG. 6D

| | A | B |
|---|---|---|
| Particle size | 26.7 microns | 19.4 microns |
| Plume distance | 610mm (24 inches) | 457mm (18 inches) |
| Plate velocity discharge rate | 500 mm/sec<br>0.16 grams/sec | 151 mm/sec<br>0.21 grams/sec |

HIGH VOLUME ATOMIZER FOR COMMON CONSUMER SPRAY PRODUCTS

FIELD OF THE DISCLOSURE

The present disclosure generally relates to atomizers for consumer spray products, and more particularly, relates to high volume atomizers which vibrate a perforated substrate in contact with a liquid product supply to dispense the liquid product.

BACKGROUND OF THE DISCLOSURE

Dispensers for releasing liquid products into the ambient air are well known in the art. These devices may deodorize, humidify, disinfect, emit a fragrance, deliver a medical or cosmetic spray, or distribute toxins into the air to kill and or repel unwanted pests, such as insects. Consequently, each application may require a different type of spray or spray property. For instance, some applications may require smaller droplets with a shorter plume length while others may require larger droplets with a longer plume length. Similar considerations may be made with respect to other attributes such as spray orientation, direction, discharge rate, or the like. Therefore, continuous efforts are directed toward new techniques of dispensing liquid products that may adapt to any and all spray requirements.

Several techniques have been employed to dispense liquid products into the air. One of the more common dispensers includes aerosol dispensers which release pressurized liquid products from gas-filled containers. Common alternatives to aerosol dispensers include atomizers which reduce a liquid product into tiny droplets and or particles to be released into the air as a fine spray. While the dispensers noted above may be useful in releasing liquid products into the ambient air, they have their drawbacks.

Aerosol dispensers have been commonly used to dispense liquid products and are well known in the art. Moreover, aerosol dispensers provide a low cost method of dispensing liquid products in any orientation and direction. In an aerosol dispenser, the liquid product to be dispensed is typically mixed in a solvent and a propellant. The propellant provides a force to expel the liquid when a user actuates the aerosol container. The two main types of propellants used in aerosol containers today are liquefied propellant gases (LPGs), such as hydrocarbon or hydrofluorocarbon (HFC) gas, and compressed gas propellants, such as compressed carbon dioxide or nitrogen gas. To a lesser extent, chlorofluorocarbon propellants (CFCs) are also used.

Propellants that use LPGs share several disadvantageous traits. While the use of CFCs is being phased out due to the harmful effects of CFCs on the environment, many aerosol dispensers still use hydrocarbon propellants. Hydrocarbon propellants contain Volatile Organic Compounds (VOCs) which may have detrimental effects on the environment. The content of VOCs in aerosol dispensers is an unwanted byproduct and is consequently regulated by various federal and state regulatory agencies, such as the Environmental Protection Agency (EPA) and California Air Resource Board (CARB).

Compressed gas propellants also possess disadvantages. Dispensers that use compressed gas propellants exhibit spray attributes that are inconsistent throughout the life of the dispenser. Specifically, their spray performance relies solely on pressure provided by the gas remaining in a container. As the gas is depleted, the spray properties of various dispensers have shown an increase in droplet size and or shorter plume lengths due to the decrease in propellant pressure. In many cases, the lack of propellant pressure leaves excessive amounts of the unused liquid product in the container.

The concept of atomizers that dispense liquids into the ambient air is also well known in the art. In general these devices supply the liquid product to a vibrating perforated plate which, due to its vibrations, consistently breaks up the liquid into fine droplets and ejects them in the form of a mist or a cloud. As the droplets travel, the liquid evaporates from the droplets and disperses into the atmosphere.

One disadvantage to atomizers pertains to the inability to spray in any direction and or orientation. Many of the atomizers do not allow transport of a liquid to the vibrating plate for atomization unless the device is upright. For instance, the capillary in a capillary-based atomizer may not be in fluid communication with the liquid product unless it is situated in the upright position. Additionally, many atomizers are not substantially sealed to prevent leaks or spills when the device is not upright.

Additional drawbacks relate to relatively large discharged particles, low discharge rates and short spray lengths. Dispensing large particles creates situations in which the droplets are too large to effectively evaporate into the ambient air. Subsequently, the droplets may eventually settle on surrounding surfaces to cause more problems than it attempts to solve. Low discharge rates and short spray lengths further limit the atomizer to only certain products and applications. For instance, an atomizer would not be able to spray a fragrance high enough to reach the center of a large room.

Nonetheless, a few advances have shown an atomizer to release smaller droplets of approximately 30 microns. While the droplet size is consistently smaller, the atomizer discharges at rates of only microliters per hour and ejects plume of less than one foot in length. Other advances have shown an atomizer outputting at increased rates of microliters per second and extending plumes to 15 centimeters. However, the reach of these sprays are still relatively short and the atomizers are still unable to spray in any direction and or orientation.

Therefore, multiple needs exist for an improved atomizer for common consumer products that is capable of spraying in any orientation, increases plume lengths, increases the delivery rate, and does not release harmful pollutants into the environment. Additional needs exist for improved atomizing techniques that may be easily adapted for use with a wide variety of applications.

SUMMARY OF THE DISCLOSURE

In accordance with one aspect of the disclosure, a high volume atomizer for dispensing a liquid product is provided which comprises an actuator; a substrate to which the actuator is operatively associated, the substrate comprising a plurality of perforations; a supply of the liquid product in contact with the perforations; and a control circuit in electrical communication with the actuator; wherein the actuator is capable of vibrating the substrate at a velocity no less than 500 mm/s and is selected from the group consisting of a piezoelectric ceramic, a piezoelectric crystal, a flextensional transducer, an oscillating magnetic couple, a high speed motor, and a servo motor.

In accordance with another aspect of the disclosure, a high volume piezoelectric atomizer for dispensing a liquid product is provided which comprises a first piezoelectric actuator; a substrate to which the piezoelectric actuator is operatively associated, the substrate comprising a plurality of perforations; a supply of the liquid product in contact with the perforations; and a control circuit in electrical communication with the piezoelectric actuator.

In accordance with another aspect of the disclosure, a high volume piezoelectric atomizer for dispensing a liquid product is provided which comprises a substantially sealed liquid chamber; an electronics chamber; a piezoelectric actuator; a substrate comprising a plurality of tapered perforations; a supply of the liquid product in contact with the tapered perforations; and a control circuit disposed within the electronics chamber, the control circuit in electrical communication with the piezoelectric actuator.

In accordance with another aspect of the disclosure, a high volume atomizer for dispensing a liquid product having a Valpey factor of at least 51.0 is provided which comprises an actuator; a substrate to which the actuator is operatively associated, the substrate comprising a plurality of perforations; a supply of the liquid product in contact with the perforations; and a control circuit in electrical communication with the actuator.

These and other aspects of this disclosure will become more readily apparent upon reading the following detailed description when taken in conjunction with the accompanying drawings.

BRIEF DESCRIPTION OF THE DRAWINGS

FIG. 6A is a table providing specifications for two exemplary plates A and B;

FIG. 6D is a table providing the spray properties of the two plates A and B of FIG. 6A.

Figure 1:
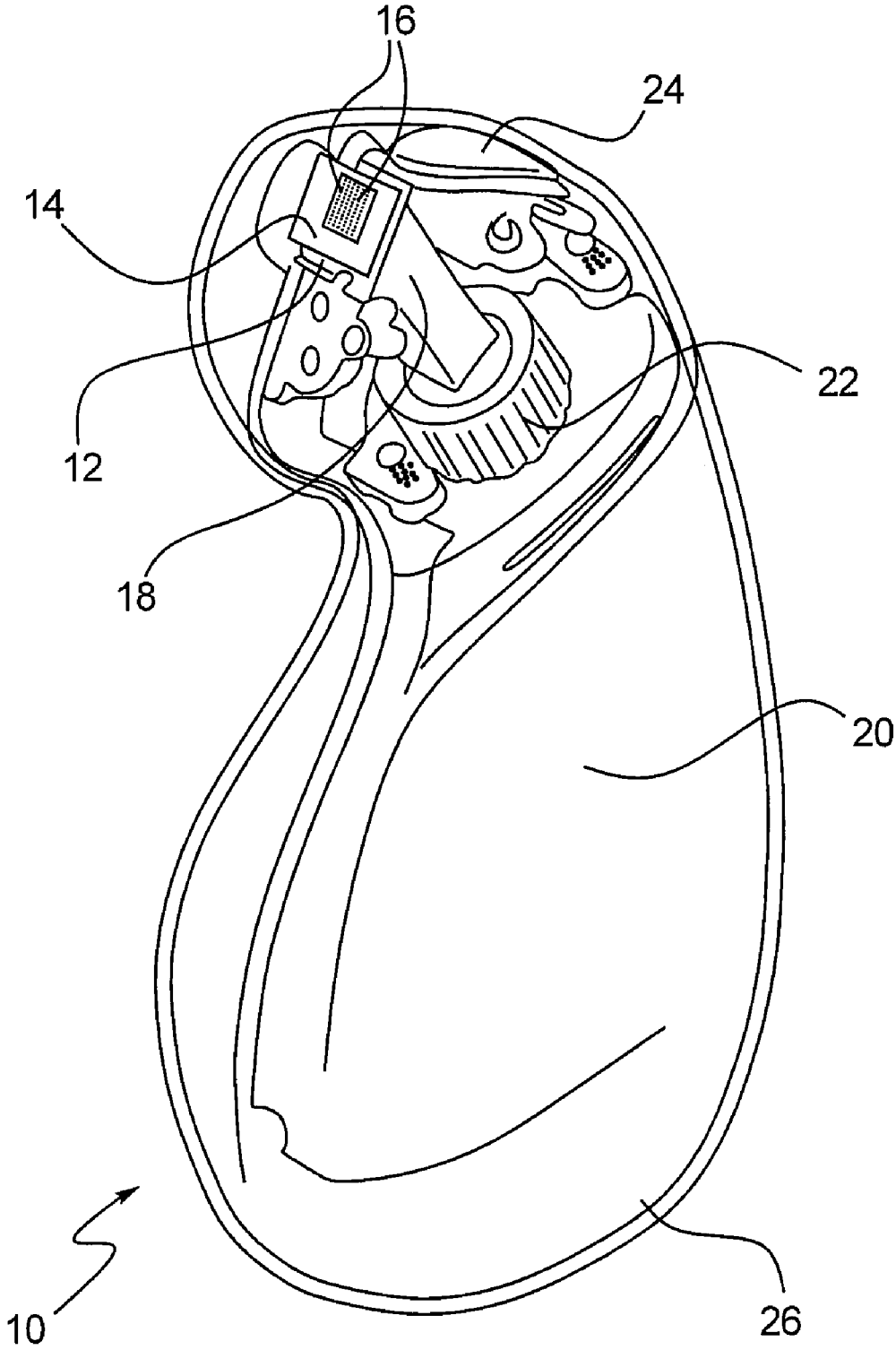
FIG. 1 is a perspective view of an exemplary high volume piezoelectric atomizer constructed in accordance with the teachings of the disclosure.

While the present disclosure is susceptible to various modifications and alternative constructions, certain illustrative embodiments thereof have been shown in the drawings and will be described below in detail. It should be understood, however, that there is no intention to limit the present invention to the specific forms disclosed, but on the contrary, the intention is to cover all modifications, alternative constructions, and equivalents falling with the spirit and scope of the present invention.

DETAILED DESCRIPTION

Referring now to the drawings and with particular reference to FIG. 1, an exemplary high volume atomizer for use with air fresheners, deodorants, insecticides, repellents, cleaners, medicinal substance, aromatherapy substance, disinfectant, sanitizer, or other common consumer spray products, is referred to as reference number 10. It is understood that the teachings of the disclosure can be used to construct atomizers and related dispensers above and beyond that specifically disclosed below. One of ordinary skill in the art will readily understand that the following are exemplary embodiments.

As shown in FIG. 1, an exemplary high volume piezoelectric atomizer 10 for common consumer spray products may include an actuator 12 and a substrate 14 to which the actuator 12 may be coupled. The actuator 12 may be a piezoelectric ceramic actuator, or may be a piezoelectric crystal, a flextensional transducer, an oscillating magnetic couple, a high speed motor, a servo motor, or any other device that may be capable of vibrating the substrate 14 at relatively high frequencies and velocities. Additionally, the substrate 14 may employ an element such as a plate, a cantilever, a diving board, or the like, that may be elliptical, rectangular, cylindrical, or in any other shape or form. The substrate 14 of FIG. 1 may further include a plurality of generally tapered perforations 16, similar to those described in U.S. Pat. Nos. 5,164,740, 6,629,646 and 6,926,208 to Ivri (the disclosures of which are hereby incorporated by reference), which may be in contact with a liquid product supply 18, such as a wick.

Wicks, as described herein, have a plurality of non-capillary fibers and are adapted to the polarity and or non-polarity of a particular liquid product. Such wick compositions serve to promote the ability to spray in any orientation and or direction, and to minimize inconsistencies caused by gravity. More specifically, gravity may significantly impede fluid flow if a wick is longer than a few millimeters and transports fluid against the force of gravity. In order to overcome gravity at delivery rates exceeding microliters per minute, the composition and properties of a wick may be modified. Some important properties affecting the performance of a wick may include the pore size, pore volume and hydrophilicity. Of these properties, hydrophilicity has the greatest impact on the performance of a wick. Furthermore, the hydrophilicity of a wick composition may be one that is compatible with the polarity of a particular liquid product to be dispensed.

The majority of liquid products that may be used with the embodiments disclosed herein may include aqueous mixtures of actives and other ingredients, for example, air fresheners, insecticides, repellents, cleaners, or the like. For such liquids, a typical hydrophilic wick, for example polyester, may be used for optimal compatibility and uninterrupted performance. In contrast, cotton may be too hydrophilic while polyethylene may be too hydrophobic. Alternatively, for applications involving non-polar liquid products, a hydrophobic wick such as polyethylene may provide better performance than cotton, nylon, polyester, or the like.

Still referring to FIG. 1, the high volume piezoelectric atomizer 10 may further include a liquid chamber 20 and a cap 22 for containing a liquid product. The wick 18 may transport a liquid product from the liquid chamber 20 to the tapered perforations 16 to be atomized. The liquid chamber 20 may be substantially sealed by the wick 18 and the cap 22 to prevent leaks and spills. Additionally, the cap 22 may include a gasket to further seal the liquid chamber 20 and to promote atomization of the liquid product in any direction and or orientation. Alternatively, the liquid chamber 20 and or cap 22 may be removable to allow for refills.

As shown in the particular embodiment of FIG. 1, the atomizer 10 may further include a trigger 24 and an electronics chamber 26 comprising a control circuit disposed therein. The electronics chamber 26 may provide electrical communication between the control circuit, the piezoelectric actuator 12 and the trigger 24. Upon engaging the trigger 24, the control circuit may be powered by at least one battery also disposed within the electronics chamber 26. Alternatively, power to the control circuit may be supplied by an external AC or DC source.

A piezoelectric actuator 12 may include a piezoelectric material that converts mechanical energy into electrical energy, and vice versa. More specifically, providing pulsed electrical current to a piezoelectric actuator 12 may mechanically vibrate the actuator 12 and its associated substrate 14. A control circuit for providing such current may be provided in electrical communication with the piezoelectric actuator 12 via wires or other conductors. Upon actuation, the control circuit may vibrate the substrate 14 and its tapered perforations 16 against a liquid product supply or a wick 18 at velocities of 500 mm/s or more. Subsequently, the atomized liquid product may be dispensed from the perforations 16 to provide plumes of approximately 2 feet (610 mm) or more in length.

Figure 2A:
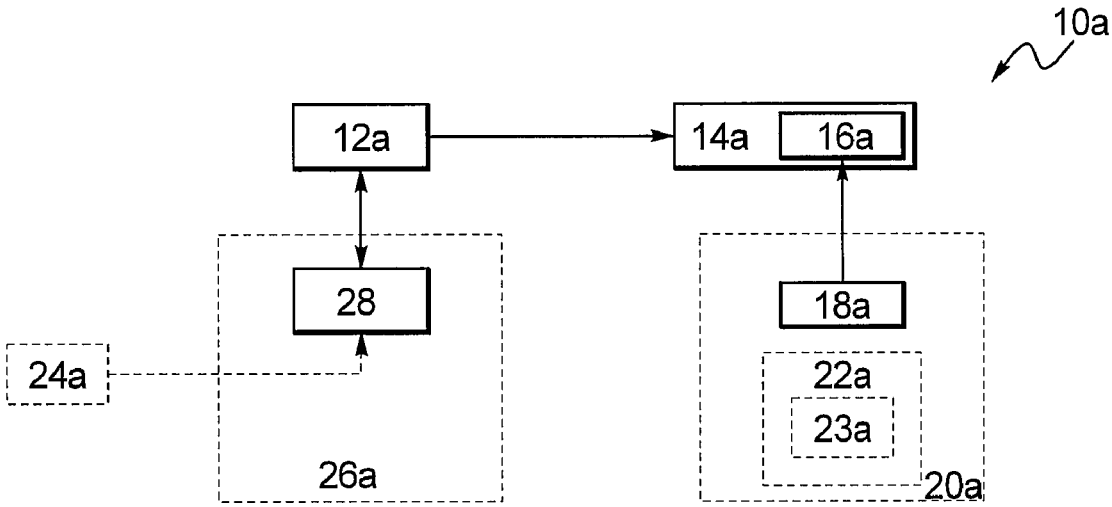
FIG. 2A is a schematic diagram of an exemplary atomizer.

Referring now to FIG. 2A, a schematic diagram further illustrates the relationships between the components of an exemplary atomizer 10*a*. In general, an atomizer 10*a* may include an actuator 12*a*, a substrate 14*a* with perforations 16*a* coupled to the actuator 12*a*, a supply of a liquid product 18*a* in contact with the substrate 14*a*, and a control circuit 28. Additionally, the atomizer 10*a* may further include a liquid chamber 20*a*, a cap 22*a*, a gasket 23*a*, a trigger 24*a*, and an electronics chamber 26*a*, as indicated in phantom. Upon engaging the trigger 24*a*, the control circuit 28 may begin vibrating the actuator 12*a*. Vibrating the actuator 12*a* may further vibrate the substrate 14*a* and its perforations 16*a* against the supply 18*a*, and atomize a liquid product contained in the liquid chamber 20*a*.

Figure 2B:
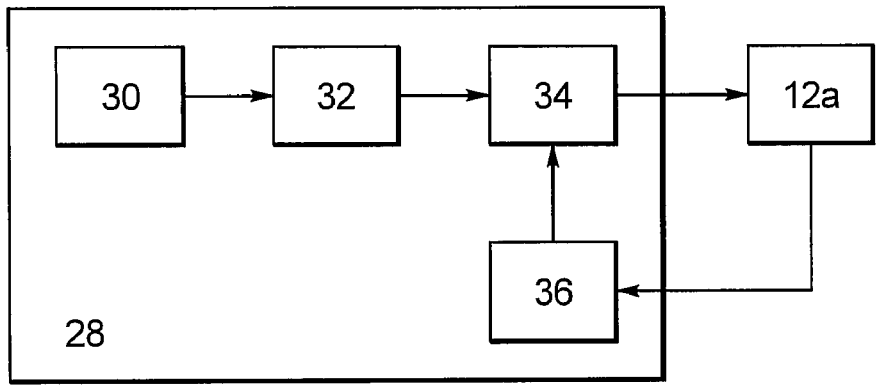
FIG. 2B is a schematic diagram of an exemplary control circuit.

Turning to FIG. 2B, a control circuit 28 may include a power supply 30, a voltage converter 32, an oscillator 34 and a feedback circuit 36. The power supply 30 may provide the voltage converter 32 with a DC voltage from an internal or an external source. The converter 32 may convert the voltage provided by the power supply 30 to a level suitable to drive the actuator 12*a*. Subsequently, the oscillator 34 may pulse the signal to vibrate the actuator 12*a*. To ensure consistent vibrations, the feedback circuit 36 may sample the vibration frequency and relay the information back to the oscillator 34. Depending on any differences between the ideal and the actual frequencies, the oscillator 34 may adjust the frequency of the signal sent to the actuator 12*a*.

Figure 3A:
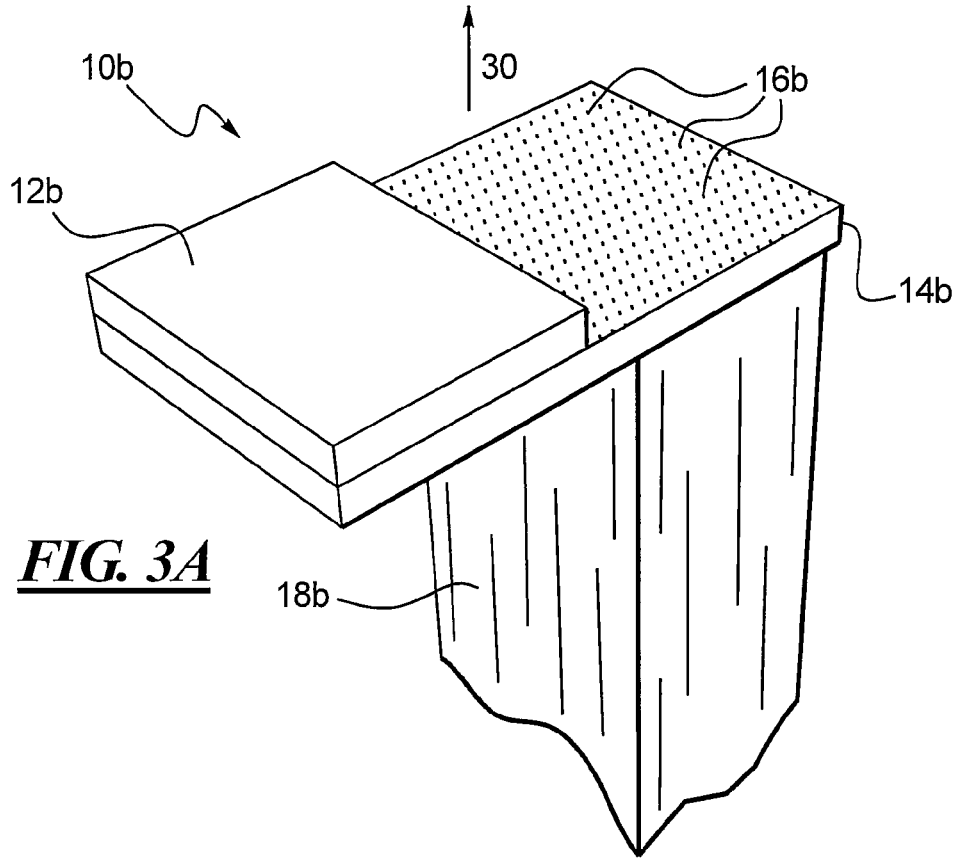
FIG. 3A is a perspective view of an atomizer with one actuator.

Turning now to FIG. 3A, another exemplary high volume piezoelectric atomizer 10*b* may include a piezoelectric ceramic actuator 12*b* and a substrate 14*b* to which the actuator 12*b* may be coupled. Alternatively, the actuator 12*b* may include a piezoelectric crystal, a flextensional transducer, an oscillating magnetic couple, a high speed motor, a servo motor, or any other device that may be capable of vibrating the substrate 14*b* at relatively high frequencies. Additionally, the substrate 14*b* may employ an element such as a plate, a cantilever, a diving board, or the like, that may be elliptical, rectangular, cylindrical, or of any other shape or form. The substrate 14*b* of FIG. 3A may further include a plurality of generally tapered perforations 16*b* which may be in contact with a supply of a liquid product, such as a wick 18*b*. The wick 18*b* may transport a liquid product from a container, a reservoir, or the like, toward the tapered perforations 16*b* to be atomized and dispensed in the general direction indicated by the exit arrow 30.

Figure 3B:
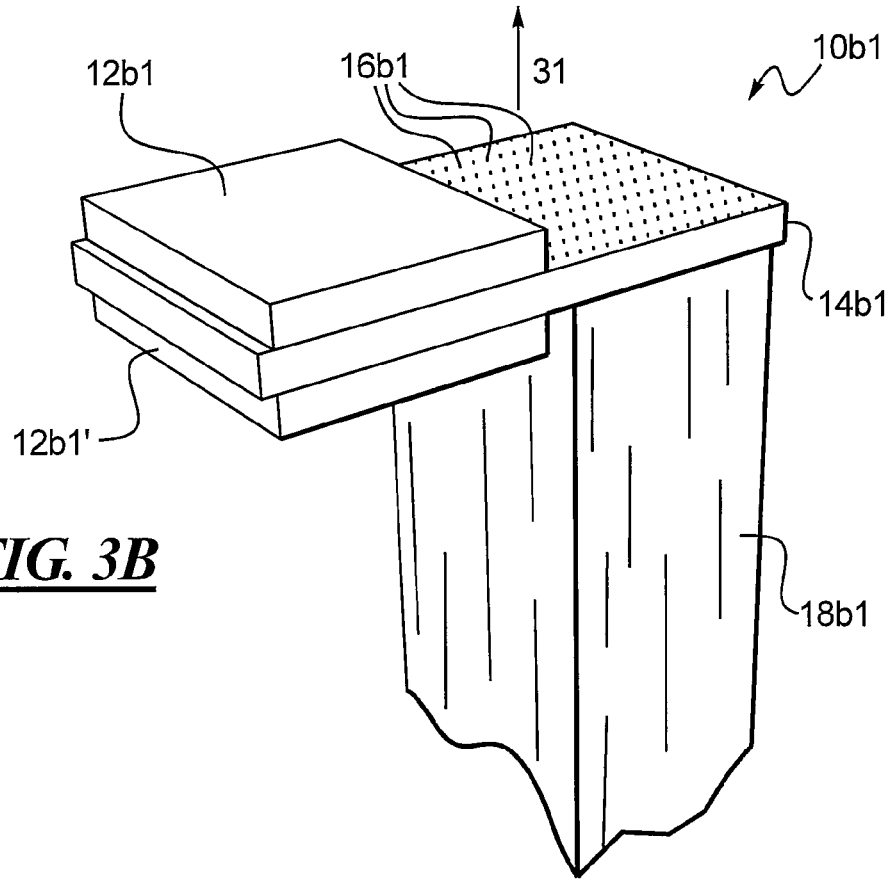
FIG. 3B is a perspective view of an atomizer with two actuators.

Turning to FIG. 3B, yet another exemplary high volume piezoelectric atomizer 10*b*1 may include two piezoelectric ceramic actuators 12*b*1, 12*b*1' and a substrate 14*b*1 to which the actuators 12*b*1, 12*b*1' may be coupled. Alternatively, the actuators 12*b*1, 12*b*1' may employ a piezoelectric crystal, a flextensional transducer, an oscillating magnetic couple, a high speed motor, a servo motor, or any other device that may be capable of vibrating the substrate 14*b* at relatively high frequencies. Additionally, the substrate 14*b*1 may include a plate, a cantilever, a diving board, or the like, that may be elliptical, rectangular, cylindrical, or of any other shape or form. As with previous embodiments, the substrate 14*b*1 of FIG. 3B may further include a plurality of generally tapered perforations 16*b*1 which may be in contact with a supply of a liquid product, such as a wick 18*b*1. The wick 18*b*1 may transport a liquid product from a container, a reservoir, or the like, toward the tapered perforations 16*b*1 to be atomized and dispensed in the general direction indicated by the exit arrow 31.

Figure 4A:
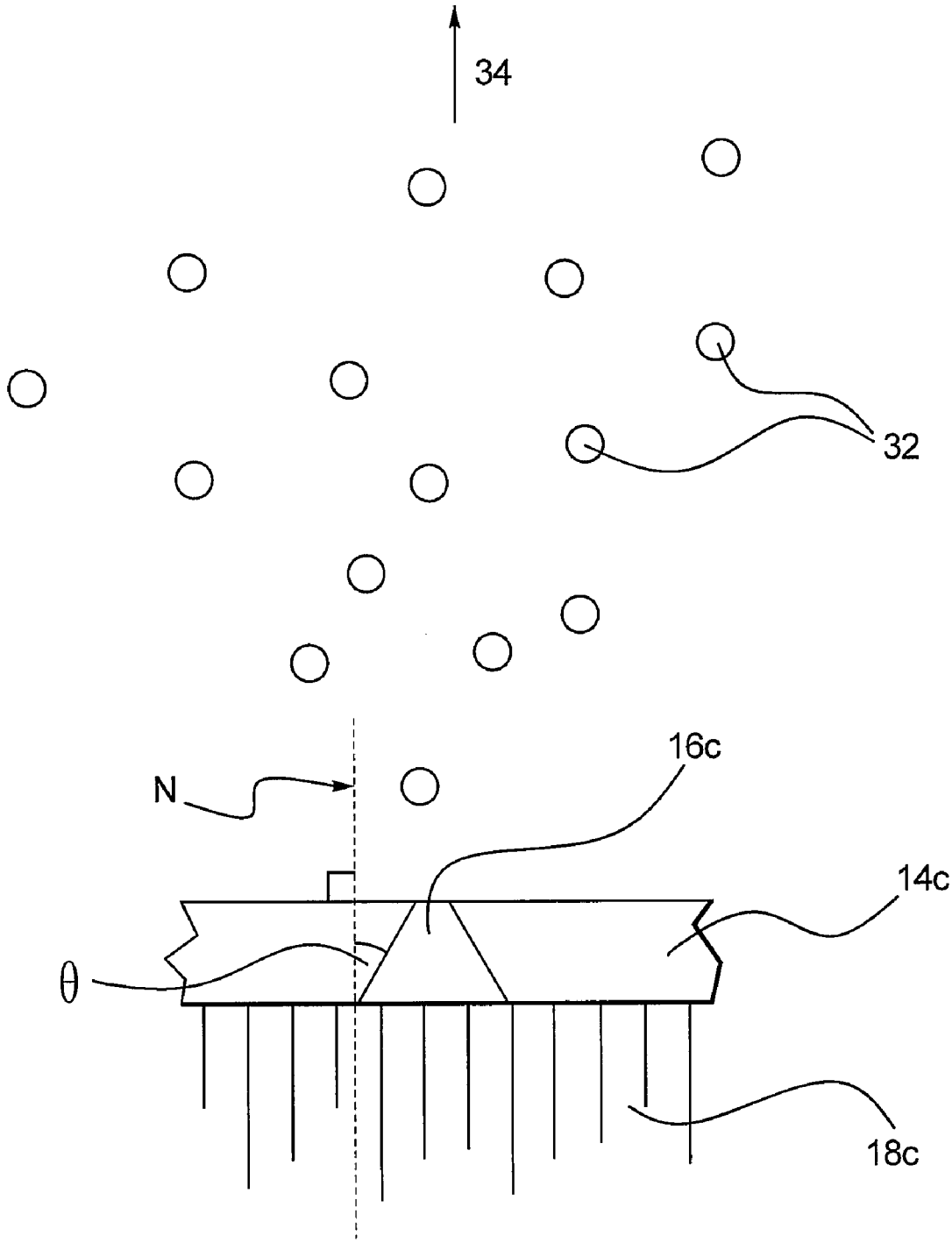
FIG. 4A-4G are magnified cross-sectional views of generally tapered perforations disposed within a substrate.
Figure 4B:
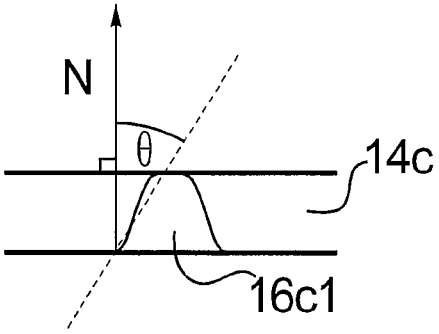
Figure 4C:
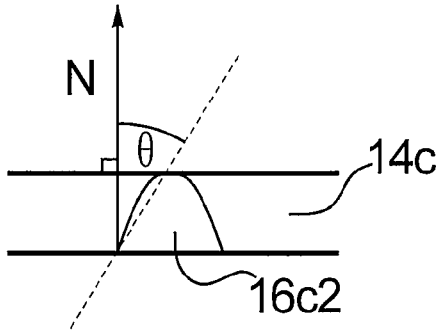
Figure 4D:
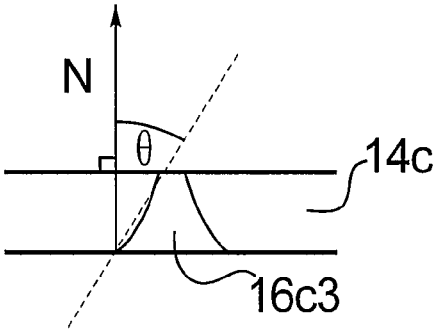
Figure 4E:
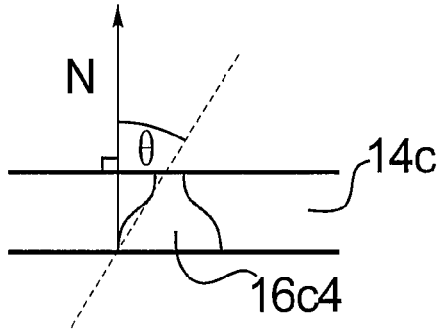
Figure 4F:
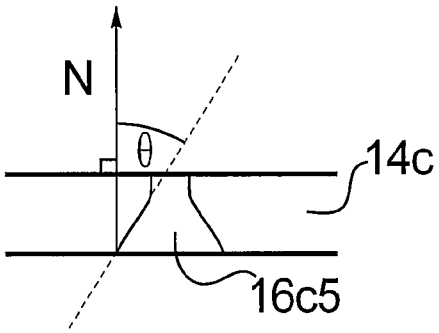
Figure 4G:
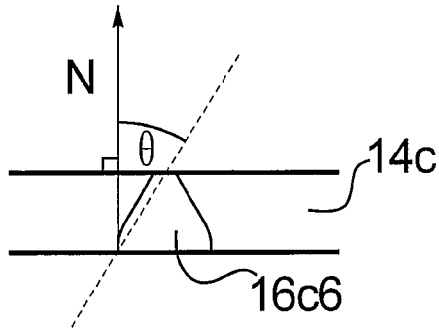

Turning to FIG. 4A, a detailed cross-sectional view of an exemplary tapered perforation 16*c* of another substrate 14*c* is shown with a wick 18*c*, or a similar supply of a liquid product. The perforation 16*c* may be tapered with an angle θ of approximately 20 to 30 degrees, and with an axis N normal to the substrate 14*c*. Alternatively, as shown in FIG. 4B, the perforation 16*c*1 may be tapered to form the shape of a bell with an average angle θ. The perforations 16*c*2, 16*c*3 of FIGS. 4C and 4D are additional variations that may be tapered to only partially mimic a bell shape and form an average angle θ with the normal axis N. Furthermore, the perforations 16*c*4-6 of FIGS. 4E-4G illustrate other possible variations that may form an average taper angle of θ with the normal axis N. As with the perforation 16*c* of FIG. 4A, each variation of FIGS. 4B-4G may form an average angle θ of approximately 20 to 30 degrees with the axis N normal to the substrate 14*c*.

Referring back to the particular embodiment of FIG. 4A, the tapered perforation 16*c* may be configured such that the larger opening of the perforation 16*c* is in direct contact with the wick 18*c*, or a similar liquid product supply. During atomization, a liquid product from the wick 18*c* may enter the perforation 16*c* through the larger opening. Subsequently, a plurality of droplets 32 may exit from the smaller opening to form a plume in the direction indicated by the exit arrow 34.

Figure 5A:
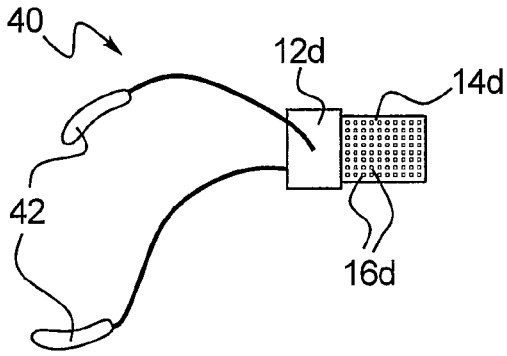
FIG. 5A is a top plan view of an exemplary actuator plate arrangement.
Figure 5B:
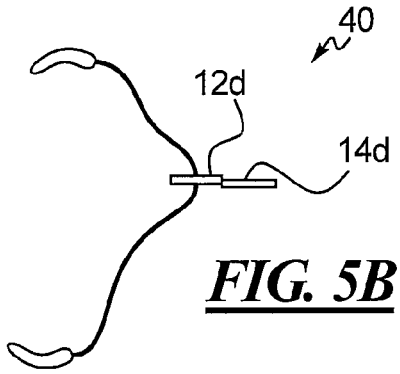
FIG. 5B is a side view of the actuator plate arrangement of FIG. 5A.
Figure 5C:
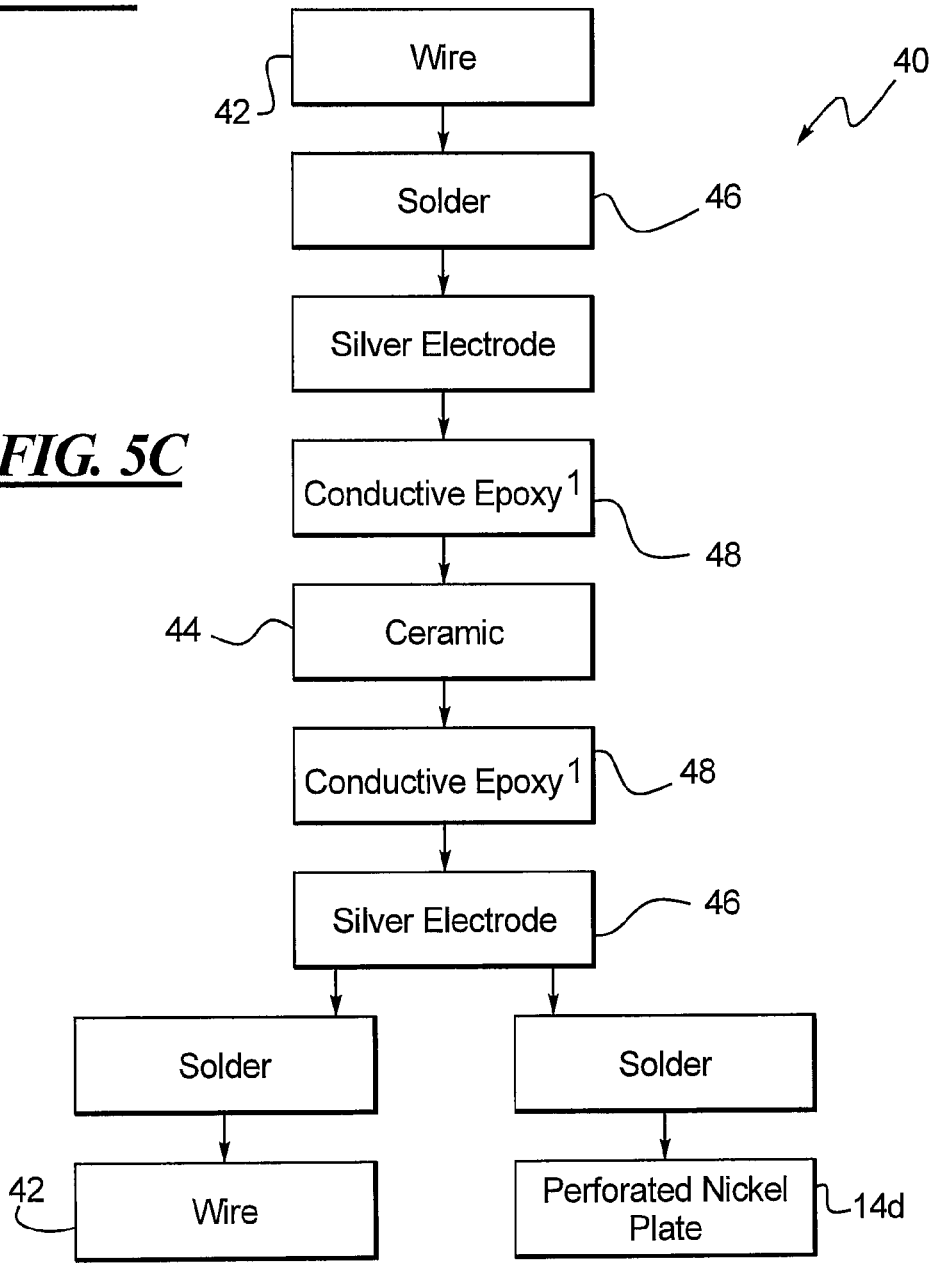
FIG. 5C is a schematic diagram used to construct the actuator plate arrangement of FIGS. 5A and 5B.

Turning now to FIGS. 5A-5C, an exemplary actuator plate arrangement 40 is provided. As in previous embodiments, the arrangement 40 may include an actuator 12*d* and a plate substrate 14*d* with a plurality of tapered perforations 16*d*. The actuator 12*d* may further include wires 42, or other similar conductors, which provide electrical communication to with a control circuit. The diagram of FIG. 5C provides an exemplary schematic that may be used to construct the particular arrangement 40 of FIGS. 5A and 5B. In the center of the arrangement 40, a piezoelectric ceramic 44 may be employed to vibrate the arrangement 40 upon actuation. Alternatively, the piezoelectric ceramic 44 may be substituted with a piezoelectric crystal, a flextensional material or any other means for vibrating the arrangement 40 at relatively high frequencies.

Still referring to the particular arrangement 40 of FIG. 5C, wires 42, or similar conductors, may be soldered to silver electrodes 46 to provide the arrangement 40 with electric current from a control circuit. The silver electrodes 46 may be coupled to the ceramic 44 using a conducting epoxy 48, or the like. In related embodiments, a thin layer of the silver 46 may be coated onto the ceramic 44 using a silk screen, or a comparable process, and subsequently applying heat to affix the coat. Furthermore, electrodes 46 made from conducting metals other than silver, for example copper, gold, brass, may also be employed.

The schematic of FIG. 5C further includes a perforated nickel plate 14*d* coupled to one of the electrodes 46. Alternatively, the nickel plate 14*d* may be a plate of a different material, a cantilever, a diving board, or any other perforated substrate that may be elliptical, rectangular, cylindrical, or in any other shape or form. The plate 14*d* may further include a plurality of perforations that are tapered at specific angles for optimal pumping efficiency. Specifically, the perforations may employ a bell shaped taper which forms average taper angles of approximately 20 to 30 degrees with an axis normal to the plate 14*d*.

Several factors may contribute to the size of the droplets released by an atomizer. The greatest known contributors may include the size of the perforations in a substrate, or a plate, and the velocity at which the plate vibrates. Moreover, at a constant plate velocity, the droplet size may increase with increasing perforation size, and at a constant perforation size, the droplet size may increase with increasing plate velocity. During the course of experimentation, however, tests provided unexpected results with respect to the particle size of droplets dispensed. It has been determined that a plate with larger perforations may produce a spray with significantly smaller droplets or particles. More specifically, at constant drive voltage and resonant frequency, higher plate velocities in combination with smaller perforations produced larger particles than lower plate velocities and larger perforations.

Turning to the table of FIG. 6A, the specifications of two different substrates, or plates, A, B that resonate at the same frequency are provided solely to illustrate the aforementioned findings. The plates A, B were constructed with different dimensions and perforation formats. Specifically, the first plate A has smaller dimensions and smaller perforations than those of the second plate B. Such variations in weight, shape, and other similar properties of the plate may cause an arrangement to vibrate at different frequencies and may require separate control circuits. Accordingly, separate control circuits were constructed to vibrate the plates A, B and to compensate for these variations. Smaller perturbations to any part of the arrangement, for example scratches, foreign objects, forces applied by a wick, components of a liquid product, or the like, may also affect performance. However, these smaller perturbations may be overcome by providing the control circuit with feedback means so as to self resonate at specific frequencies.

Figure 6B:
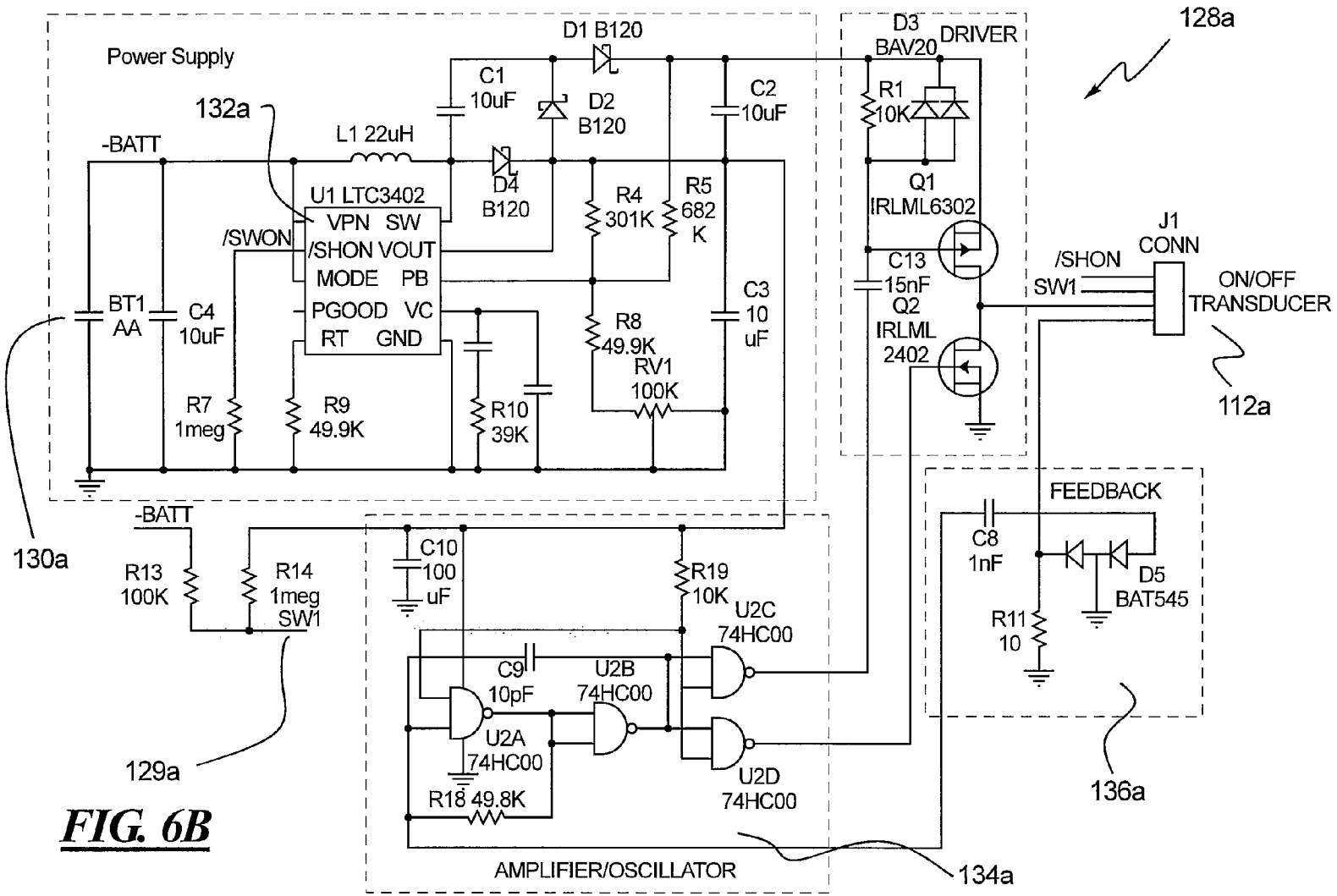
FIG. 6B is a schematic diagram of a control circuit for use with the first plate A of FIG. 6A.

Turning now to FIG. 6B, an exemplary control circuit 128*a* for driving the first actuator 112*a* of arrangement A is provided. The control circuit 128*a* may include a switch 129*a*, a battery 130*a*, a boost converter 132*a*, an oscillator 134*a* and a feedback circuit 136*a*. Upon actuation of the switch 129*a*, the battery 130*a* supplies a DC voltage to the boost converter 132*a*. The boost converter 132*a* converts the input voltage to a higher DC voltage required to drive the actuator 112*a*. Simultaneously, the oscillator 134*a* and the feedback circuit 136*a* determine the optimum operating frequency, or series resonant frequency, by sampling current passing through the actuator 112*a*. By self resonating and maintaining the series resonant frequency, the control circuit 128*a* minimizes impedance and allows the arrangement A to be operated at a relatively low voltage. Accordingly, the control circuit 128*a* is able to consistently drive power to the load 112*a* and overcome small perturbations.

Figure 6C:
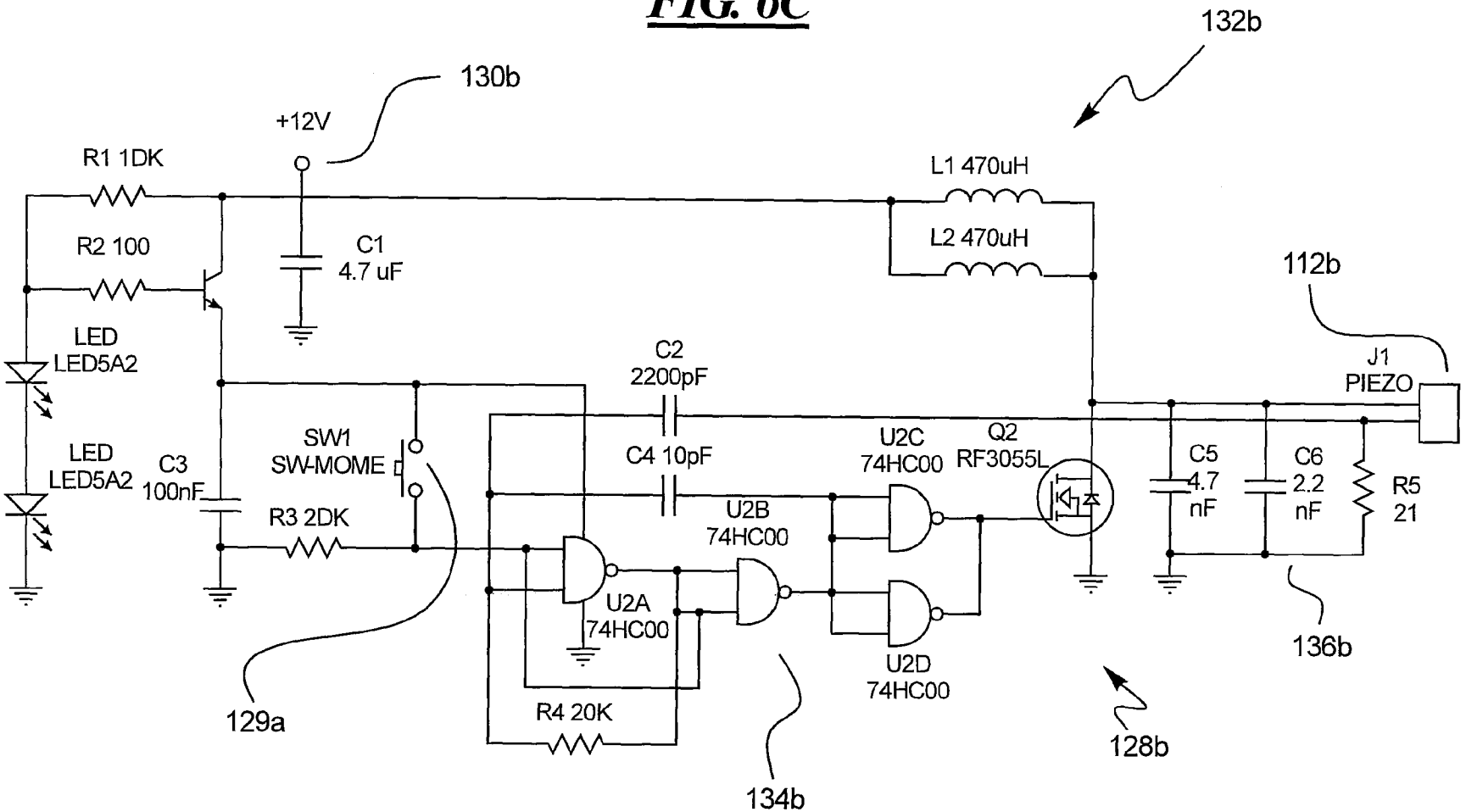
FIG. 6C is a schematic diagram of a control circuit for use with the second plate B of FIG. 6A.

Turning now to FIG. 6C, a second exemplary control circuit 128*b* for driving the second actuator 112*b* of arrangement B is provided. Similar to the previous circuit 128*a*, the control circuit 128*b* may include a switch 129*b*, a DC power supply 130*b*, an impedance transformation network 132*b*, an oscillator 134*b* and a feedback circuit 136*b*. Upon actuation of the switch 129*b*, the power supply 130*b* feeds DC voltage to the impedance transformation network 132*b*, which converts the incoming voltage to a higher AC voltage required to drive the actuator 112*b*. As in the control circuit 128*a* of FIG. 6B, the oscillator 134*b* and the feedback circuit 136*b* work together to vibrate the plate arrangement B more efficiently. Specifically, the oscillator 134*b* and the feedback circuit 136*b* determine the series resonant frequency by sampling current passing through the actuator 112*b*. As a result, the second control circuit 128*b* is also able to consistently drive power to the load and overcome small perturbations.

Referring now to FIG. 6D, the resulting properties of sprays from both arrangements A, B are provided. Data corresponding to the particle size of the droplets from each spray were collected on a Malvern™ Mastersizer S analyzer. At least five measurements were taken at a distance of 8 inches from each plate A, B, and averaged. The plume distance was estimated subjectively by observers over multiple sprays, and averaged. For this particular experiment, each spray was discharged vertically and the corresponding plume distance was estimated to be the reach of the majority of the spray. Alternative means for measuring plume distance may also be employed. The perforation or plate velocity was measured on a Polytec® PSV-400 Scanning Laser Dopler Vibrometer. Furthermore, the discharge rate was determined through the change in weight of sprays over an interval of 10 seconds. The results presented are averages of three trials.

The results provided in FIG. 6D emphasize the significance of plate velocity and its ability to vary the size of dispensed droplets. Moreover, despite its larger perforations, droplets produced by the second plate B were significantly smaller than those produced by the first plate A. This is due to the difference in plate velocities between the two arrangements A, B. More specifically, plate A moved much faster than plate B. Although both arrangements A, B were driven at the same resonant frequency, plate A moved faster because of its smaller structure.

In general, the performance of an atomizer may be measured by examining the properties of its spray. More relevant spray properties may include the size of the droplets, plume length and the rate of discharge. A simplified approach to measuring atomizer performance may combine these traits into one index, for example, a Valpey factor. The Valpey factor may be defined by the equation $$V_f = 100 r_d + 0.1 l_p - x_d$$

where $r_d$ is the discharge rate in g/s, $l_p$ is the observed plume length in mm, and $x_d$ is the droplet size in microns. The Valpey factor summarizes atomizer performance, by combining the droplet size, plume length and the discharge rate of an atomizer into one index.

Based on the foregoing, it can be seen that the present disclosure provides a high volume atomizer with features that improves efficiency and performance. Using the embodiments and the relationships disclosed herein, it is possible to atomize a liquid product into smaller droplets, longer plumes and greater discharge rates. More specifically, an atomizer constructed in accordance with the teachings of the disclosure is capable of providing plume lengths of approximately 2 ft (610 mm) or more and discharge rates of approximately 0.20 g/s or more. Accordingly, the performance of the present disclosure may be summarized to exhibit a Valpey factor of 51.0 or more. Atomizers currently existing in the art exhibit only a fraction of this value.

Furthermore, the present disclosure is capable of atomizing in any orientation without leaking and without significantly affecting performance. The atomizer includes a liquid chamber with a cap and a gasket, and a novel plate arrangement that is in direct contact with a supply of a liquid product to substantially seal in a liquid product. Moreover, the supply of a liquid product is not provided by capillary action but by using the polarity or non-polarity of a liquid product. The technology allows the device to atomize consistently while it is upright, upside down, sideways, or in any other orientation. This is a significant improvement over atomizers currently existing in the art which may leak, spill or not work at all in such orientations. While a few atomizers may be able to spray in these positions without leaking, their performance is inconsistent and gradually decreases in quality.

While only certain embodiments have been set forth, alternatives and modifications will be apparent from the above description to those skilled in the art. These and other alternatives are considered equivalents and within the spirit and scope of this disclosure.

What is claimed is:

1. A high volume atomizer for dispensing a liquid product, comprising:

a substrate comprising a plurality of perforations;

a supply of the liquid product;

a wick extending from the supply of liquid product and that is in contact with the perforations, the wick being composed entirely of non-capillary fibers;

a first actuator and a second actuator capable of vibrating the substrate at a velocity no less than 500 mm/s and are selected from the group consisting of a piezoelectric ceramic, a piezoelectric crystal, a flextensional transducer, an oscillating magnetic couple, a high speed motor, and a servo motor;

the substrate disposed between the first and second actuators; and a control circuit in electrical communication with the first actuator.

2. The atomizer of claim 1, wherein the substrate is a cantilever.

3. The atomizer of claim 1, wherein the perforations are tapered at approximately 20 to 30 degree angles with an axis normal to the substrate.

4. The atomizer of claim 1, further comprising a liquid chamber substantially sealed with a cap and a gasket.

5. The atomizer of claim 1, wherein the control circuit comprises a power supply, a voltage converter, an oscillator and a feedback circuit.

6. The atomizer of claim 1, wherein the control circuit is disposed within an electronics chamber.

7. A high volume piezoelectric atomizer for dispensing a liquid product, comprising:

a first piezoelectric actuator;

a substrate to which the first piezoelectric actuator is operatively associated, the substrate comprising a plurality of perforations;

a second piezoelectric actuator, the substrate disposed between the first and second piezoelectric actuators;

a supply of the liquid product including a wick in contact with the perforations; and a control circuit in electrical communication with the first piezoelectric actuator.

8. The piezoelectric atomizer of claim 7, wherein the substrate is a cantilever.

9. The piezoelectric atomizer of claim 7, wherein the perforations are tapered at approximately 20 to 30 degree angles with an axis normal to the substrate.

10. The piezoelectric atomizer of claim 7, further comprising a liquid chamber substantially sealed with a cap and a gasket.

11. The piezoelectric atomizer of claim 7, wherein the wick comprises polyester for use with polar liquid products.

12. The piezoelectric atomizer of claim 7, wherein the wick comprises polyethylene for use with non-polar liquid products.

13. The piezoelectric atomizer of claim 7, wherein the control circuit comprises a power supply, a voltage converter, an oscillator and a feedback circuit.

14. The piezoelectric atomizer of claim 7, wherein the control circuit is disposed within an electronics chamber.

15. The piezoelectric atomizer of claim 7, wherein the control circuit provides a substrate velocity greater than 500 mm/s.

16. A high volume piezoelectric atomizer for dispensing a liquid product, comprising:

a substantially sealed liquid chamber;

an electronics chamber;

a first piezoelectric actuator;

a substrate comprising a plurality of tapered perforations;

a second piezoelectric actuator, the substrate being disposed between the first and second piezoelectric actuators;

a supply of the liquid product including a wick in contact with the tapered perforations; and a control circuit disposed within the electronics chamber, the control circuit in electrical communication with the piezoelectric actuators.

17. The piezoelectric atomizer of claim 16, wherein the liquid chamber further comprises a cap and a gasket.

18. The piezoelectric atomizer of claim 16, wherein the subs cantilever.

19. The piezoelectric atomizer of claim 16, wherein the perforations are tapered at approximately 20 to 30 degree angles with an axis normal to the substrate.

20. The piezoelectric atomizer of claim 16, wherein the control circuit comprises a power supply, a voltage converter, an oscillator and a feedback circuit.

21. The piezoelectric atomizer of claim 16, wherein the control circuit provides a substrate velocity greater than 500 mm/s.

22. A high volume atomizer for dispensing a liquid product, comprising:

an actuator;

a substrate to which the actuator is operatively associated, the substrate comprising a plurality of perforations;

a supply of the liquid product including a wick in contact with the perforations; and a control circuit in electrical communication with the actuator, the atomizer having a Valpey factor of at least 51.0.

23. The piezoelectric atomizer of claim 22, wherein the actuator comprises a piezoelectric material.

24. The piezoelectric atomizer of claim 22, wherein the perforations are tapered at approximately 20 to 30 degree angles with an axis normal to the substrate.

25. The piezoelectric atomizer of claim 22, further comprising a liquid chamber substantially sealed with a cap and a gasket.

26. The piezoelectric atomizer of claim 22, wherein the control circuit comprises a power supply, a voltage converter, an oscillator and a feedback circuit.

27. The piezoelectric atomizer of claim 22, wherein the control circuit is disposed within an electronics chamber.

* * * * *

UNITED STATES PATENT AND TRADEMARK OFFICE

CERTIFICATE OF CORRECTION

PATENT NO. : 7,891,580 B2
APPLICATION NO. : 12/112714
DATED : February 22, 2011
INVENTOR(S) : Richard S. Valpey, III et al.

It is certified that error appears in the above-identified patent and that said Letters Patent is hereby corrected as shown below:

Column 10, Line 31 Claim 18: replace “subs” with --substrate is a--

Signed and Sealed this
Twenty-seventh Day of September, 2011

David J. Kappos

David J. Kappos
*Director of the United States Patent and Trademark Office*